US007523729B2

(12) United States Patent
Rozario et al.

(10) Patent No.: US 7,523,729 B2
(45) Date of Patent: Apr. 28, 2009

(54) ROCKER ASSEMBLY WITH ADJUSTABLE SWIVEL FOOT

(75) Inventors: Frederick J. Rozario, Fenton, MI (US); Rodney E. Baker, Fenton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 1 day.

(21) Appl. No.: 11/674,366

(22) Filed: Feb. 13, 2007

(65) Prior Publication Data

US 2008/0190389 A1 Aug. 14, 2008

(51) Int. Cl.
*F01L 1/18* (2006.01)

(52) U.S. Cl. ..... 123/90.4; 123/90.39; 123/90.43

(58) Field of Classification Search ..... 123/90.22, 123/90.23, 90.39–90.47, 90.61–90.64
See application file for complete search history.

(56) References Cited

U.S. PATENT DOCUMENTS 6,505,589 B1 1/2003 Hayman et al.
2004/0045518 A1* 3/2004 Abe ..... 123/90.41

* cited by examiner

*Primary Examiner*—Zelalem Eshete

(57) ABSTRACT

A rocker assembly for a valve train having a first valve, a second valve, and a pushrod is provided. The rocker assembly includes a rocker having a first arm in contact with the first valve, a second arm in contact with the second valve, and a third arm in contact with the pushrod, the first arm having a bore formed therethrough. An adjustable swivel foot includes a first portion having threads and a second portion, the adjustable swivel foot coupled to the first arm such that the first portion extends through the bore of the first arm and the second portion is engageable with the first valve, and a threaded member is included that is engaged with the threads of the first portion of the adjustable swivel foot, the threaded member operable to position the second portion relative to the rocker.

14 Claims, 3 Drawing Sheets

ROCKER ASSEMBLY WITH ADJUSTABLE SWIVEL FOOT

FIELD

The present disclosure relates to valve trains, and more particularly to a valve train having a rocker assembly with an adjustable swivel foot.

BACKGROUND

The statements in this section merely provide background information related to the present disclosure and may or may not constitute prior art.

Internal combustion engines typically include an arrangement of pistons and cylinders located within an engine block. In a four stroke engine, each cylinder has at least two valves. These valves control the flow of air to the combustion cylinders and allow for venting of combustion exhaust gasses. A simple valve arrangement includes an intake valve and an exhaust valve, each actuated by a valve train. The valve train typically includes a camshaft with cam followers that actuate respective pushrods and rocker assemblies. The rocker assemblies in turn actuate respective intake and exhaust valves.

With the introduction of more than one intake or exhaust valve per cylinder, rocker assemblies have been developed to actuate more than one valve. An exemplary rocker assembly and valve train for a two valve arrangement is disclosed in commonly owned U.S. Pat. No. 6,505,589, herein incorporated by reference in its entirety as if fully disclosed herein. While useful for its intended purpose, there is room in the art for an improved rocker assembly having an adjustable swivel foot to assist in compensating for variations in the valve train.

SUMMARY

In one aspect of the present invention, a rocker assembly for a valve train having a first valve, a second valve, and a pushrod is provided.

In another aspect of the present invention, the rocker assembly includes a rocker having a first arm in contact with the first valve, a second arm in contact with the second valve, and a third arm in contact with the pushrod, the first arm having a bore formed therethrough. An adjustable swivel foot is included having a first portion and a second portion, the first portion having threads formed thereon, the adjustable swivel foot coupled to the first arm such that the first portion extends through the bore of the first arm and the second portion is engageable with the first valve, and a threaded member is included that is engaged with the threads of the first portion of the adjustable swivel foot, the threaded member and the threads of the first portion operable to position the second portion relative to the rocker to adjust for the position of the first valve stem.

In another aspect of the present invention the threaded member is formed on an inner surface of the bore.

In another aspect of the present invention a fastener is engageable with the first portion to fix the position of the second portion relative to the rocker.

In another aspect of the present invention the fastener includes a plurality of threads formed thereon for engaging the threads formed on the first portion.

In another aspect of the present invention the fastener is a lock nut.

In another aspect of the present invention the bore is formed through the first arm extends from a bottom surface of the first arm to a top surface of the first arm.

In another aspect of the present invention the fastener engages the top surface of the first arm when the fastener is engaged with the first portion.

In another aspect of the present invention the rocker includes a second bore that defines a pivot axis.

In another aspect of the present invention the rocker includes a ledge formed on a side of one of the first arm or second arm, the ledge extending from the second bore along either the first arm or the second arm.

In another aspect of the present invention the rocker includes a slot formed in the second bore proximate to the ledge such that lubrication is directed from the second bore through the slot onto the ledge in order to allow lubrication to drip onto one of the first valve or the second valve.

In another aspect of the present invention a fixed swivel foot is disposed within a third bore formed in the second arm, the fixed swivel foot operable to engage the second valve.

In another aspect of the present invention the second arm includes a hole extending from the third bore to a top surface of the second arm to allow air within the bore to escape when the fixed swivel foot is positioned within the third bore.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
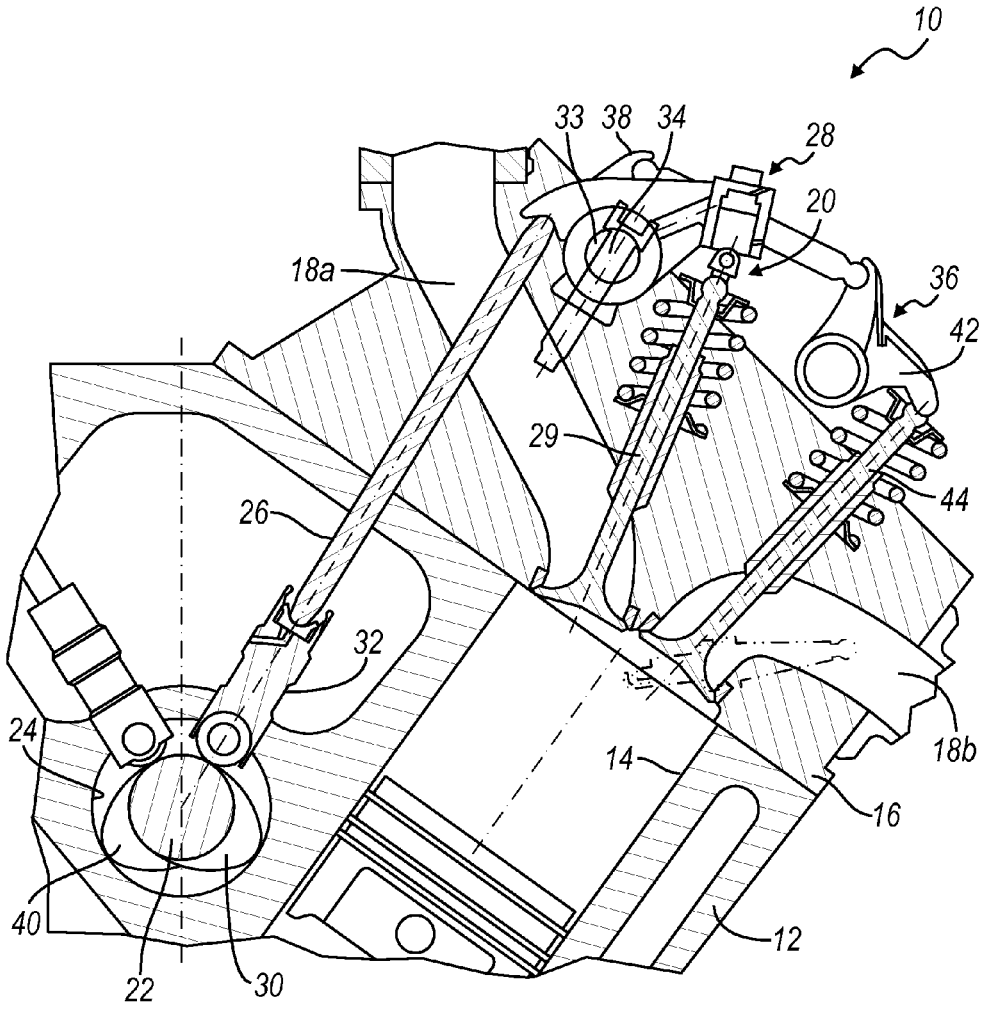
FIG. 1 is a side elevational view of a rocker arm assembly according to the principles of the present invention illustrated in an exemplary valve train in an internal combustion engine.

Referring now to FIG. 1, a portion of an internal combustion engine is illustrated and generally designated by the reference number 10. The internal combustion engine 10 includes an engine block 12 which defines a plurality of cylinders 14, only one of which is illustrated in FIG. 1. A cylinder head 16 is secured to the top of the engine block 12 and defines at least one inlet passageway 18A and one exhaust passageway 18B for each cylinder 14.

The internal combustion engine 10 also includes an exemplary valve train 20. The valve train 20 includes a camshaft 22 which is received and supported for rotation in a bore 24 within the engine block 12. In the particular example provided, the cylinders 14 are arranged in a V-type arrangement and the camshaft 22 is located at the bottom of the "V". However, it should be appreciated that various other cylinder 14 and camshaft 22 arrangements may be employed with the present invention.

The valve train 20 also includes a pushrod 26, a rocker arm assembly 28, and a pair of inlet valves 29, only one of which is shown. The camshaft 22 includes an inlet cam 30 that engages a hydraulic roller lifter 32 at an end of the pushrod 26. The pushrod 26 is coupled at an opposite end thereof to the rocker assembly 28. The rocker assembly 28 is in turn coupled to the pair of inlet valves 29, as will be described in further detail below.

During operation of the valve train 20, rotation of the camshaft 22 and the inlet cam 30 reciprocates the hydraulic roller lifter 32 and the pushrod 26. The pushrod 26 then actuates the rocker assembly 28 such that the rocker assembly 28 oscillates on a supporting shaft 33 about a pivot axis 34. The pivot axis 34 is parallel to the axis of the camshaft 24. As the rocker assembly 28 is actuated by the reciprocating pushrod 26, the rocker assembly 28 opens and closes the pair of inlet valves 29. The inlet valves 29 are in communication with the cylinders 14 and allow air intake into the cylinders 14 as the camshaft 22 rotates and the pushrod 26 reciprocates.

An exhaust valve train 36 is also illustrated with the engine 12. The exhaust valve train 36 includes an exhaust pushrod 38 (the top of which is shown) that is reciprocated by an exhaust cam 40 on the camshaft 22. The exhaust pushrod 38 in turn oscillates an exhaust rocker arm 42, which reciprocates an exhaust valve 44. The exhaust valve train 36 operates in a manner similar to the valve train 20, though the opening and closing of the exhaust valve 44 is out of synch with the opening and closing of the pair of inlet valves 29.

Figure 2:
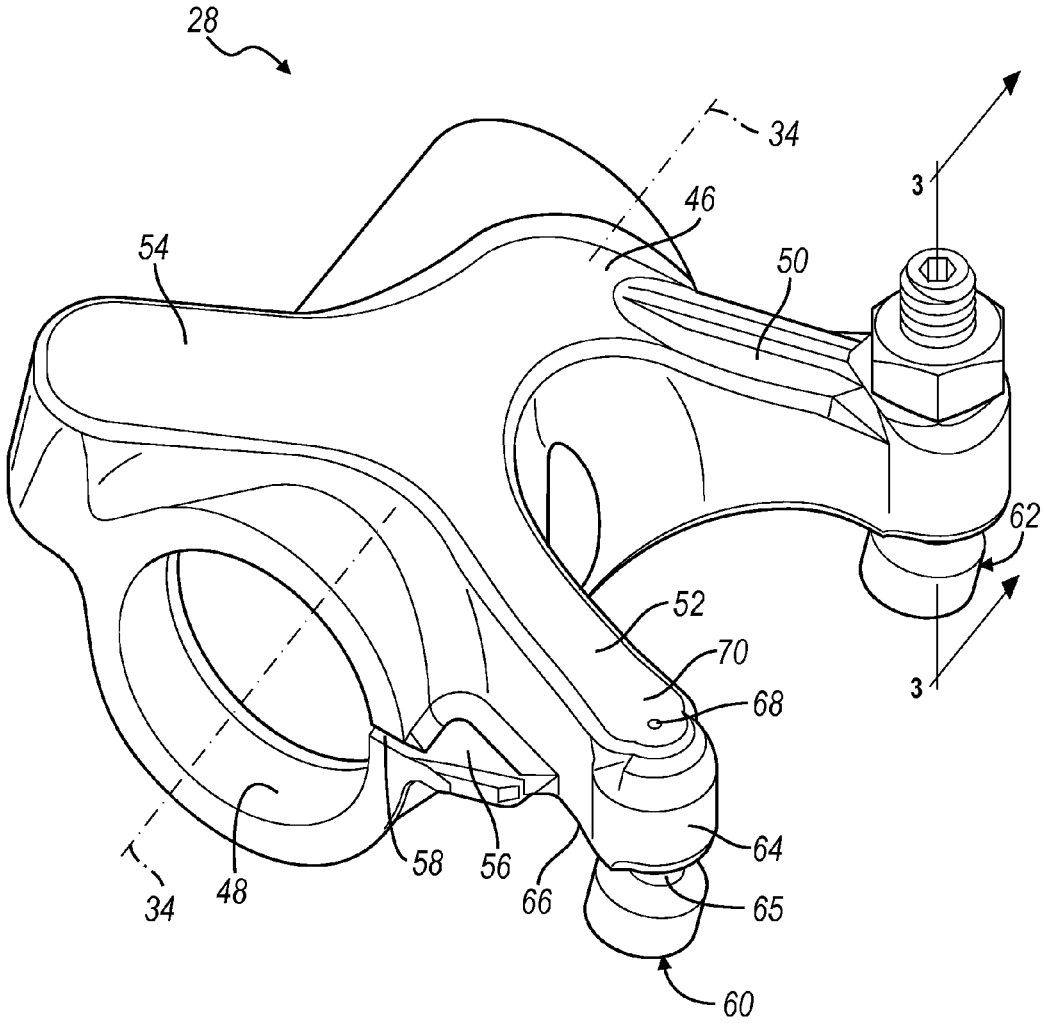
FIG. 2 is an isometric view of the rocker arm assembly of the present invention.

With reference to FIG. 2 and continued reference to FIG. 1, the rocker assembly 28 of the present invention used in the above described exemplary engine 10 and valve train 20 is illustrated. The rocker assembly 28 includes a rocker body 46 that defines a cylindrical bore 48. The cylindrical bore 48 is parallel to the pivot axis 34 and is sized to receive the supporting shaft 33 therein. Three rocker arms extend from the rocker body 46 and include a first rocker arm 50, a second rocker arm 52, and a third rocker arm 54. The rocker body 46 and the rocker arms 50, 52, and 54 include features such as cross-sectional shape, ribs and fillets that are designed using computer assisted finite element analysis in order to optimize strength, mass and stiffness.

The first rocker arm 50 and the second rocker arm 52 extend from one side of the rocker body 46 and the third rocker arm 54 extends from the opposite side. In the particular example provided, the first arm 50 and the second arm 52 extend from the rocker body 46 such that each is non-perpendicular to the pivot axis 34 to form a "V" shape with the rocker body 46 located at the base of the "V". The third arm 54 also extends from the rocker body 46 non-perpendicularly to the pivot axis 34 and is located opposite the second arm 52. However, it should be appreciated that the location and angles of the rocker arms 50, 52, 54 may be varied without departing from the scope of the present invention.

A ledge 56 is disposed on a side of the second arm 52 and extends to the cylindrical bore 48. A slot 58 is located in the rocker body 46 proximate to the ledge 56 between the ledge 56 and the cylindrical bore 48. Oil or other lubrication is pumped by the hydraulic roller lifter 32 through the pushrod 26, through the third rocker arm 54 into the cylindrical bore 48, and then through the slot 58 and onto the ledge 56. The ledge 56 then directs the oil to the end of the second arm 52 where the oil can drip onto the inlet valves 29 to aid in lubrication. A second ledge and second slot may be formed on an opposite side of the second arm 52. Additionally, a slot and ledge may be formed proximate to the first arm 50 or the third arm 54 to deliver lubrication to the arms 50, 54.

The rocker assembly 28 further includes a fixed swivel foot 60 and an adjustable swivel foot 62. The fixed swivel foot 60 is connected to an end 64 of the second rocker arm 52. Specifically, the fixed swivel foot 60 is inserted into a receiver 65 formed on a bottom surface 66 of the second rocker arm 52. An air purge hole 68 is disposed in a top surface 70 of the second rocker arm 52. The air purge hole 68 extends into the receiver 65. During assembly of the rocker assembly 28, when the fixed swivel loot 60 is inserted into the receiver 65 of the second rocker arm 52, air within the receiver 65 is allowed to escape through the air purge hole 68. The fixed swivel foot 60 may optionally include a hydraulic lash adjuster. An exemplary fixed swivel foot having a hydraulic lash adjuster is disclosed in commonly owned U.S. Pat. No. 5,680,838, hereby incorporated by reference as if fully disclosed herein. The fixed swivel foot 60 engages one of the pair of inlet valves 29 and allows rotation between the inlet valves 29 and the second rocker arm 52.

Figure 3:
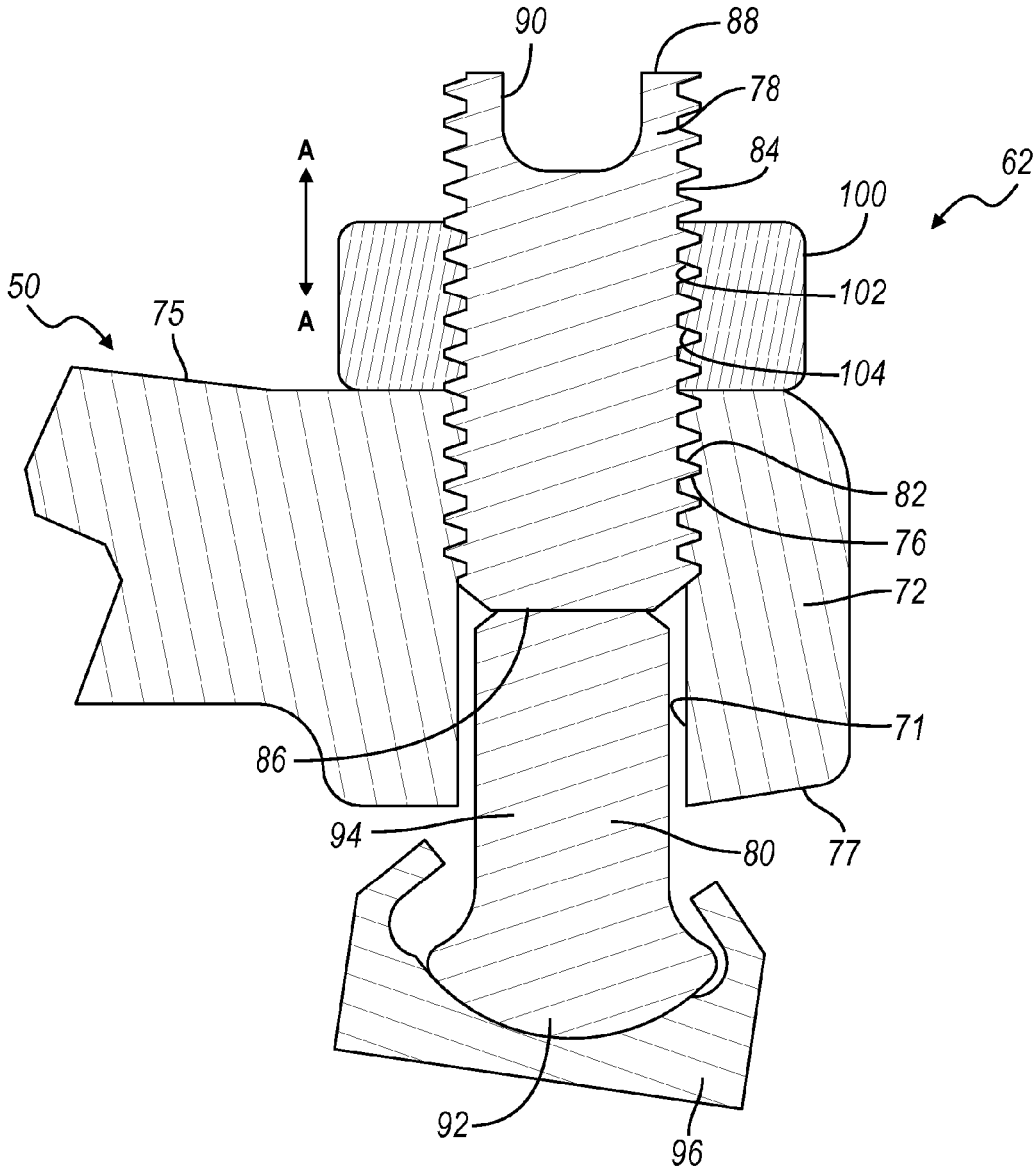
FIG. 3 is a cross-sectional view of the rocker assembly taken in the direction of arrow 3-3 shown in FIG. 2.

Turning now to FIG. 3, the adjustable swivel foot 62 is coupled to an end 72 of the first rocker arm 50. Specifically, the first rocker arm 50 includes a bore 74 formed through the terminal end 72 sized to receive the adjustable swivel foot 62. The bore 74 extends from a top surface 75 of the first rocker arm 50 to a bottom surface 77 of the first rocker arm 50. The bore 74 includes a plurality of threads 76 formed thereon for engaging the adjustable swivel foot 62, as will be described in further detail below.

The adjustable swivel foot 62 includes a post portion 78 and a head portion 80. The post portion 78 is generally cylindrical in shape and includes a plurality of threads 82 formed on an outer surface 84 thereof. The threads 82 extend along at least a portion of the length of the post portion 78. The threads 82 are sized to engage the threads 76 formed on the bore 74 of the first rocker arm 50, as will be described in further detail below. The post portion 78 includes a first end 86 and a second end 88 opposite the first end 86. The first end 86 is generally flat and engages the head portion 80. Alternatively, the post portion 78 and the head portion 80 may be formed as a single unitary piece. A socket 90 is formed in the second end 88 of the post portion 78. In the particular example provided, the socket 90 is hexagonally shaped and is sized to receive a tool (not shown) for rotating the post portion 78 or holding the post portion 78 stationary. Alternatively, the socket 90 may have any other shape sized to receive any other tool.

The head portion 80 includes a ball 92 coupled to a neck 94. The ball 92 has a hemi-spherical shape. The neck 94 and ball 92 extend out from the bore 74 of the first rocker arm 50. A ball cup 96 is coupled to the ball 92 such that the ball cup 96 receives the ball 92 therein. The ball cup 96 is free to move relative to the ball 92. The ball cup 96 is operable to engage one of the pair of inlet valves 28.

As noted above, the adjustable swivel foot 62 is coupled to the first rocker arm 50 such that the post portion 78 is at least partially disposed within the bore 74 such that the head portion 80 at least partially extends out from the bore 74. The position of the head portion 80 relative to the first rocker arm 50 may be adjusted by rotating the post portion 78 such that the threads 76 and 82 engage one another, thereby moving the adjustable swivel foot 62 in the direction of arrows "A-A".

In the particular example provided, the post portion 78 extends out from the top surface 75 of the first rocker arm 50. Once the position of the adjustable swivel foot 62 has been set, a fastener 100 defining a bore 102 having a plurality of threads 104 formed thereon is coupled to the post portion 78. Specifically, the fastener 100 is threaded onto the portion of the post portion 78 that extends out from the top surface 75 of the first rocker arm 50. The fastener 100 contacts the top surface 75 and acts to lock the position of the adjustable swivel foot 62 relative to the first rocker arm 50. In the particular example provided, the fastener 100 is illustrated as a threaded lock nut, though it should be appreciated that various kinds of fasteners may be employed, such as, for example, a c-clip.

By having the post portion 78 engage a threaded member either coupled to the first rocker arm 50 or formed thereon, the adjustable swivel foot 68 is adjustable to properly engage the inlet valve 28. This proper engagement reduces lash and allows for adjustments to be made to the rocker assembly 28 during assembly.

The description of the invention is merely exemplary in nature and variations that do not depart from the gist of the invention are intended to be within the scope of the invention. Such variations are not to be regarded as a departure from the spirit and scope of the invention.

What is claimed is:

1. A rocker assembly for a valve train having a first valve, a second valve, and a pushrod, the rocker assembly comprising:

a rocker having a first arm in contact with the first valve, a second arm in contact with the second valve, and a third arm in contact with the pushrod, the first arm having a bore formed therethrough, wherein the rocker includes a second bore that defines a pivot axis, the rocker including a ledge formed on a side of at least one of the first arm and the second arm, the ledge extending from the second bore at least partially along either the first arm or the second arm;

an adjustable swivel foot having a first portion and a second portion, the first portion having threads formed thereon, the adjustable swivel foot coupled to the first arm such that the first portion extends through the bore of the first arm and the second portion is engageable with the first valve; and a threaded member engaged with the threads of the first portion of the adjustable swivel foot, the threaded member and the threads of the first portion operable to position the second portion relative to the rocker to adjust for the position of the first valve.

2. The rocker assembly of claim 1 wherein the threaded member is formed on an inner surface of the bore.

3. The rocker assembly of claim 2 further comprising a fastener engageable with the first portion to fix the position of the second portion relative to the rocker.

4. The rocker assembly of claim 3 wherein the fastener includes a plurality of threads formed thereon for engaging the threads formed on the first portion.

5. The rocker assembly of claim 4 wherein the fastener is a lock nut.

6. The rocker assembly of claim 4 wherein the bore formed through the first arm extends from a bottom surface of the first arm to a top surface of the first arm.

7. The rocker assembly of claim 6 wherein the fastener engages the top surface of the first arm when the fastener is engaged with the first portion.

8. The rocker assembly of claim 1 further comprising a fixed swivel foot disposed within a third bore formed in the second arm, the fixed swivel foot operable to engage the second valve.

9. The rocker assembly of claim 8 wherein the second arm includes a hole extending from the third bore to a top surface of the second arm to allow air within the bore to escape when the fixed swivel foot is positioned within the third bore.

10. The rocker assembly of claim 1 wherein the rocker includes a slot formed in the second bore proximate to the ledge such that lubrication is directed from the second bore through the slot onto the ledge in order to allow lubrication to drip onto one of the first valve or the second valve.

11. A rocker assembly for a valve train having a first valve, a second valve, and a pushrod, the rocker assembly comprising:

a rocker having a first arm in contact with the first valve, a second arm in contact with the second valve, and a third arm in contact with the pushrod, the first arm having a first bore formed therethrough and the second arm having a second bore formed therethrough;

an adjustable swivel foot having a first portion and a second portion, the first portion having threads formed thereon, the adjustable swivel foot coupled to the first arm such that the first portion extends through the bore of the first arm and the second portion is engageable with the first valve;

a threaded member engaged with the threads of the first portion of the adjustable swivel foot, the threaded member and the threads of the first portion operable to position the second portion relative to the rocker to adjust for the position of the first valve; and a fixed swivel foot disposed within the second bore, the fixed swivel foot operable to engage the second valve, and wherein the second arm includes a hole extending from the second bore to a top surface of the second arm to allow air within the second bore to escape when the fixed swivel foot is positioned within the second bore.

12. The rocker assembly of claim 11 wherein the rocker includes a second bore that defines a pivot axis.

13. The rocker assembly of claim 12 wherein the rocker includes a ledge formed on a side of one of the first arm or second arm, the ledge extending from the second bore along either the first arm or the second arm.

14. The rocker assembly of claim 13 wherein the rocker includes a slot formed in the second bore proximate to the ledge such that lubrication is directed from the second bore through the slot onto the ledge in order to allow lubrication to drip onto one of the first valve or the second valve.

* * * * *